US011026456B2

(12) United States Patent
Smith

(10) Patent No.: US 11,026,456 B2
(45) Date of Patent: Jun. 8, 2021

(54) ONE-PIECE LOOPED SCARF

(71) Applicant: Asma Smith, Atlanta, GA (US)

(72) Inventor: Asma Smith, Atlanta, GA (US)

( * ) Notice: Subject to any disclaimer, the term of this patent is extended or adjusted under 35 U.S.C. 154(b) by 0 days.

(21) Appl. No.: 16/170,551

(22) Filed: Oct. 25, 2018

(65) Prior Publication Data

US 2019/0307188 A1 Oct. 10, 2019

Related U.S. Application Data

(60) Provisional application No. 62/654,169, filed on Apr. 6, 2018.

(51) Int. Cl.
*A41D 23/00* (2006.01)

(52) U.S. Cl.
CPC ..... *A41D 23/00* (2013.01)

(58) Field of Classification Search
CPC .. A41D 23/00; A41D 2025/002; A41D 13/11; A41D 13/1107; A41D 13/1161; A41D 2023/004; A41D 2200/20
USPC ..... 2/17, 209.13, 174, 173
See application file for complete search history.

(56) References Cited

U.S. PATENT DOCUMENTS 1,797,226 A * 3/1931 Chumbley ..... A41D 23/00 2/91
2,130,933 A 9/1938 Sweet
2,421,934 A * 6/1947 Golfieri ..... A41D 23/00 2/204
4,321,709 A * 3/1982 Steinberg ..... A41D 23/00 2/207
4,942,627 A * 7/1990 Copprue ..... A41D 23/00 2/207
5,144,696 A * 9/1992 Kahl ..... A41D 23/00 2/103
6,145,131 A * 11/2000 Huff ..... A41D 23/00 2/171
6,226,799 B1 * 5/2001 Lane ..... A41D 23/00 2/207
D518,625 S * 4/2006 Barnhouse ..... D2/866
7,028,345 B2 4/2006 Waldman
7,096,511 B2 8/2006 Cohen
7,467,422 B2 12/2008 Bugarin
9,138,028 B2 * 9/2015 Bier ..... A43B 13/12
9,826,787 B2 * 11/2017 Wu ..... A41D 13/11
10,206,440 B2 * 2/2019 Treyger ..... A41D 15/00
2006/0253958 A1 * 11/2006 Debrick ..... A41D 27/18 2/206
2008/0209614 A1 * 9/2008 Beausang ..... A42B 1/041 2/207
2009/0151048 A1 * 6/2009 Laury ..... A42B 1/043 2/202
2011/0126340 A1 * 6/2011 Wu ..... A41D 23/00 2/88

(Continued)

*Primary Examiner* — Gloria M Hale
(74) *Attorney, Agent, or Firm* — Binita J. Singh; Thomas E. LaGrandeur; Bold IP, PLLC

(57) ABSTRACT

Embodiments are provided for a one-piece clothing garment that forms an integrated headband and scarf. Additionally, the headband and scarf are formed in a way that the headband is sewn at an upward angle forming an indent at the connection point that provides neck protection without air leakage. Also, a method of forming a one-piece clothing garment that has a scarf portion and a headband portion is disclosed.

20 Claims, 3 Drawing Sheets

(56) References Cited

U.S. PATENT DOCUMENTS

| | | | | |
|---|---|---|---|---|
| 2011/0209266 | A1* | 9/2011 | Perry | A41D 23/00 2/207 |
| 2014/0230128 | A1* | 8/2014 | Nguyen | A41D 23/00 2/207 |
| 2015/0201687 | A1* | 7/2015 | Graves | A41D 23/00 2/207 |
| 2019/0110534 | A1* | 4/2019 | Carter | A41D 23/00 |

* cited by examiner

ONE-PIECE LOOPED SCARF

CROSS-REFERENCE TO RELATED APPLICATIONS

This application claims priority to U.S. Provisional Application No. 62/654,169 filed Apr. 6, 2018, which is incorporated by reference in its entirety.

FIELD OF THE DISCLOSURE

This disclosure relates generally to the field of clothing and garments. More specifically, the present disclosure relates to a one-piece garment that has the features of a scarf and a headband, and a method of making said garment.

BACKGROUND

People who live in cold climates know the value of keeping your neck and forehead warm. Various types of garments (e.g. scarves, headbands, hats) have been developed that cover the neck and the wearer's head to keep them warm. These garments are very important in staying warm in a cold climates or cold buildings, and especially important for young children who are more susceptible to the cold. If, for example, a child's neck and head are exposed to cold weather, they are at risk of catching a cold or other illness as their immune system can be lowered from exposure to low temperatures.

Thus, wearers of hats and scarves, and other winter garments, value how important it is to keep their necks and head warm in cold weather. Traditional combinations of garments is effective, however, drawbacks persist with their use. Scarves may come unraveled with activity and often prove difficult to readjust for proper facial coverage. Hats often leave the user's hair in a flattened and unkept condition. Additionally, the combination of using a hat and a scarf, as two separate garments, can leave a separation between the two garments that allows for cold air to pass through.

There have been some attempts to provide alternatives. For example, U.S. Pat. No. 7,096,511 discloses a clothing garment that is formed in two loops or bands as a unitary garment. Specifically, this patent discloses a clothing garment comprising a unitary garment formed of two fabric units that are combined to form an integrated garment. This patent uses two loops of fabric which are removably fasted at one section of the loops and is adjustable via the fastener.

Although this patent application includes a scarf in the form of a two-looped garment, whereby said first loop and said non-rectangular second loop are attached together via a fastener, this patent application still includes several disadvantages as that of a traditional scarf and hat combination. More specifically, by being formed of two separate fabric units, one unit being non-rectangular, and having the garment fabric units be detachable from one another, this patent fails to provide a one-piece solution that does not allow air to leak through the neck region of the garment.

Due to all of the existing shortcomings in presently available garments, there is still a need for a clothing garment that provides a solution for the problems present in the prior art.

SUMMARY

The disclosure presented herein relates to a one-piece clothing garment having a headband portion and a scarf portion, allowing a user to cover their neck and head in a cold environment, utilizing a one-piece clothing garment that will not allow the leakage of cold air. In one or more non-limiting examples, a one-piece clothing garment as described in one or more embodiments herein may be used as a clothing article that keeps the wearer's neck, ears, and forehead warm. Those of ordinary skill will appreciate that other uses may be foreseeable also and are included within the scope of the present description.

In one aspect, the present invention relates to a method of making a one-piece clothing garment.

In one aspect, one or more embodiments for a one-piece garment are provided in the present description, whereby the one-piece garment includes a forehead portion and a scarf portion. The forehead portion having a first loop that is comprised of a first elongated side and a second elongated side, whereby said first elongated side and second elongated side are sewn together to form a tube. Further, the one-piece garment includes a scarf portion that includes a first elongated side and a second elongated side, whereby the first elongated side and second elongated side are sewn together to form a second a first tube. Further, the scarf portion and the head band portion are formed from one-piece of fabric.

The preceding and following embodiments and descriptions are for illustrative purposes only and are not intended to limit the scope of this disclosure. Other aspects and advantages of this disclosure will become apparent from the following detailed description.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
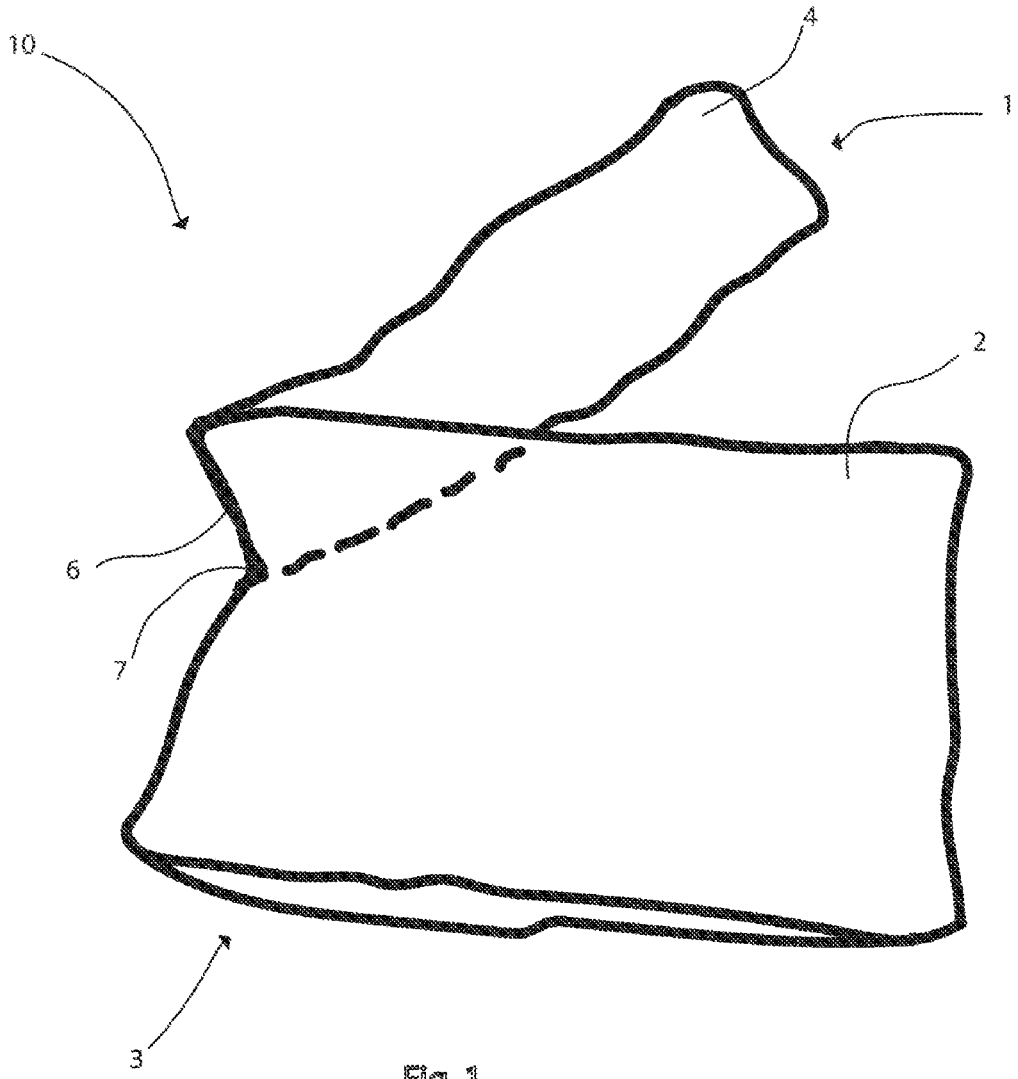
FIG. 1 is a side view of a one-piece clothing garment according to various aspects of the present invention.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B and C can consist of (i.e., contain only)

components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present description includes one or more embodiments for a one-piece clothing garment that may be worn by a user, where the headband portion can be easily pulled down to allow a user to cover their ears or other aspects of their head, while the scarf portion stays in place and covers the wearer's neck. The one or more embodiments for a one-piece clothing garment include multiple elements. For example, in one or more embodiments, various headband shapes or materials may be formed to better protect a wearer's head. Elements included herein are meant to be illustrative, rather than restrictive. Persons having ordinary skill in the art relevant to the present disclosure may understand there to be equivalent elements that may be substituted with the present disclosure.

As best seen in FIG. 1, a one-piece clothing garment 10 can be seen having a headband portion 1 and a scarf portion 3. The headband portion 1 and scarf portion 3 are integrated at connection point 6, with the headband portion inside of the scarf portion. The headband portion 1 is made out of a first loop 4, and the scarf portion 3 is made out of a second loop 2. In this embodiment, the first loop 4 is connected with the second loop 2 at connection point 6. This connection point 6 runs the entire width of the first loop 4, as the one-piece garment is formed from one-piece of clothing material.

The one-piece clothing garment also contains an indent 7. This indent 7 is the result of the one-piece clothing garment 10 being formed from one-piece of clothing material (as described below) and is formed when non-integrated end (FIG. 2 number 24) of the first loop 4, and the non-integrated end (FIG. 2 number 29) of the second loop 2 are connected at the integrated ends 31 and 21, respectfully, of FIG. 2. The indent 7 formed during the formation of the one-piece clothing garment 10 serves the purpose of keeping a wearer's neck covered due to the first and second loops being formed from one-piece of clothing material. This one-piece design prevents the passage of air to the user's neck as there is no open space for air to leak through.

In one non-limiting embodiment, the scarf portion and the headband portion both have widths that are constant without any portions that are substantially wider.

The two loops can be in an overlying relationship and the first loop 4 can be used to cover the ears of the wearer. The second loop 2, can be used to protect the neck of the wearer.

In one embodiment, the headband portion 1, and the scarf portion 3, are formed out of one-piece of clothing material. This clothing material can include any known fabrics commonly used to make a scarf or headband. This embodiment can include stretchable fabrics or non-stretchable fabrics. This is advantageous as using one-piece of clothing material to form the one-piece clothing unit 10 allows for a seamless integrated connection of the headband portion 1, and the scarf portion 2, as one-piece of clothing material is used for the entire garment without being separated. This will prevent air leakage at the back of the neck of the wearer.

In a further embodiment non-limiting embodiment, the headband portion and the scarf portion are formed out of two different materials.

Figure 2:
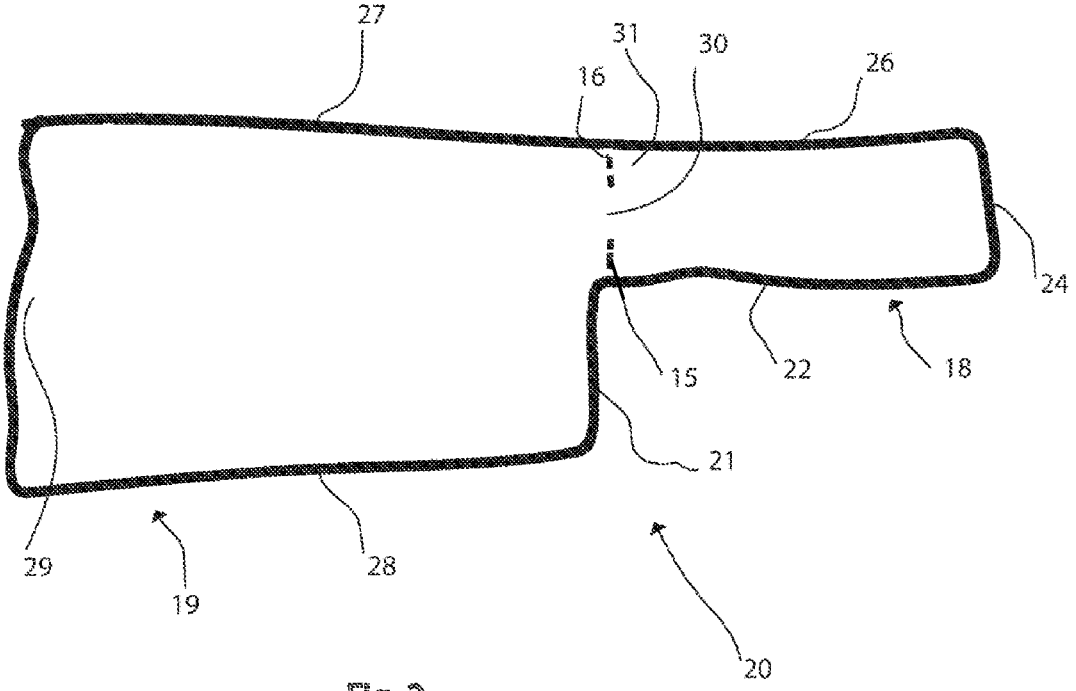
FIG. 2 is a top view of a piece of cloth used to make a one-piece clothing garment according to various aspects of the present invention.

Turning to FIG. 2, FIG. 2 shows a top view of a piece of clothing material 20 used to make a one-piece clothing garment. In this embodiment, a one-piece clothing garment, as shown in FIG. 1 is formed out of the one-piece clothing material 20, and comprises a first slit 15 and a second slit 16, a headband portion 18 comprising; a first loop (FIG. 1 number 4) formed by an elongated first side 26 and second side 22 that are sewn together to form a first tube shape having an integrated end 31 and a first non-integrated end 24; a scarf portion 19 made of a second loop (FIG. 1 number 2), said second loop being made of an elongated third side 27 and fourth side 28 that are sewn together to form a second tube shape having a second non-integrated end 21 and third non-integrated end 29. In this embodiment, the connection point 30 is sewn together with first integrated end 31 to form said first loop and said third non-integrated end 29 is sewn together with said connection point 30 and said second non-integrated end 21 to form said second loop.

In forming the one-piece clothing garment shown in FIG. 1, a single piece of clothing material as shown in FIG. 2 must first be cut out. The one-piece of clothing material can be any fabric acceptable in common use of a headband or scarf. In one embodiment, the single piece of fabric includes any combination of polyesters, cottons, wool, denim, leather, down, fur, nylon, spandex, or any other material acceptable to form a one-piece of clothing material. In the FIG. 2 embodiment, the clothing material is cut into a scarf portion 19, and a headband portion 18. In some embodiments, the scarf portion 19 and headband portion 18 may be of equal width. In some embodiments, the scarf portion 19 or the headband portion 18 may be wider than the other, for example to have extra material for comfort and styling. In some embodiments, the shape of the clothing material may be cut to accommodate a greater or narrower width to cover the ears or any other reason. In this embodiment, before the one-piece of clothing material is formed into the one-piece clothing garment, the headband portion 18 has a first elongated side 26 and second elongated side 22, and a first non-integrated end 24 and an integrated end 31. The integrated end is designated integrated as this end is integrated with the scarf portion 19 at connection point 30. Further, in this embodiment, the scarf portion has a third elongated side 27 and forth elongated side 28, as well as a second non-integrated end 21 and a third non-integrated end 29.

After the shape of the one-piece clothing material 20 is cut out of a clothing material, a first slit 15 and a second slit 16 are cut at connection point 30 between the scarf portion and the headband portion. In one non-limiting embodiment, these slits on both sides are around 2 inches. These slits are cut in order to allow the formation of the first and second loop as detailed below, and in one non-limiting embodiment, are only cut partially through the width of the fabric and do not sever the clothing material into two pieces.

After the slits 15 and 16 are cut, the headband portion 18 is formed into a tube shape by sewing together the first 26 and second 22 elongated sides to form said tube shape having connection point 30 and first non-integrated end 24. In another embodiment, the elongated sides are not sewn, but are connected together in any known method commonly used to make clothing garments.

The scarf portion 19 is then formed into a tube shape by sewing together the third elongated side 27 with the forth elongated side 28 to form said tube shape having second non-integrated side 21 and third non-integrated side 29.

In one embodiment, after the tube shape of the headband portion 18 and the loop shape of the scarf portion 19 are formed by sewing together the elongated sides detailed above, both of the tube shapes are pulled inside out in order to hide the sewing seams.

After the completion of the above steps, in one embodiment, the first loop is formed by attaching the end of the first non-integrated end 24 to the top of the connection point 30.

In one non-limiting embodiment, the single stitching instead of double stitching is used to form the one-piece clothing garment shown in FIG. 1. In a further embodiment, any other attachment means commonly used in the formation of clothing garments can be used.

In one embodiment, the second loop is formed by attaching the third non-integrated end 29 to the connection point 30 and the second non-integrated end 21. In a further embodiment, the lower portion of the third non-integrated end 29 is double stitched to the lower portion of the second non-integrated end 21, forming a scarf, and the upper portion of the third non-integrated end 29 is double stitched with the connection point 30 and the first non-integrated end 24, forming a headband.

Figure 3:
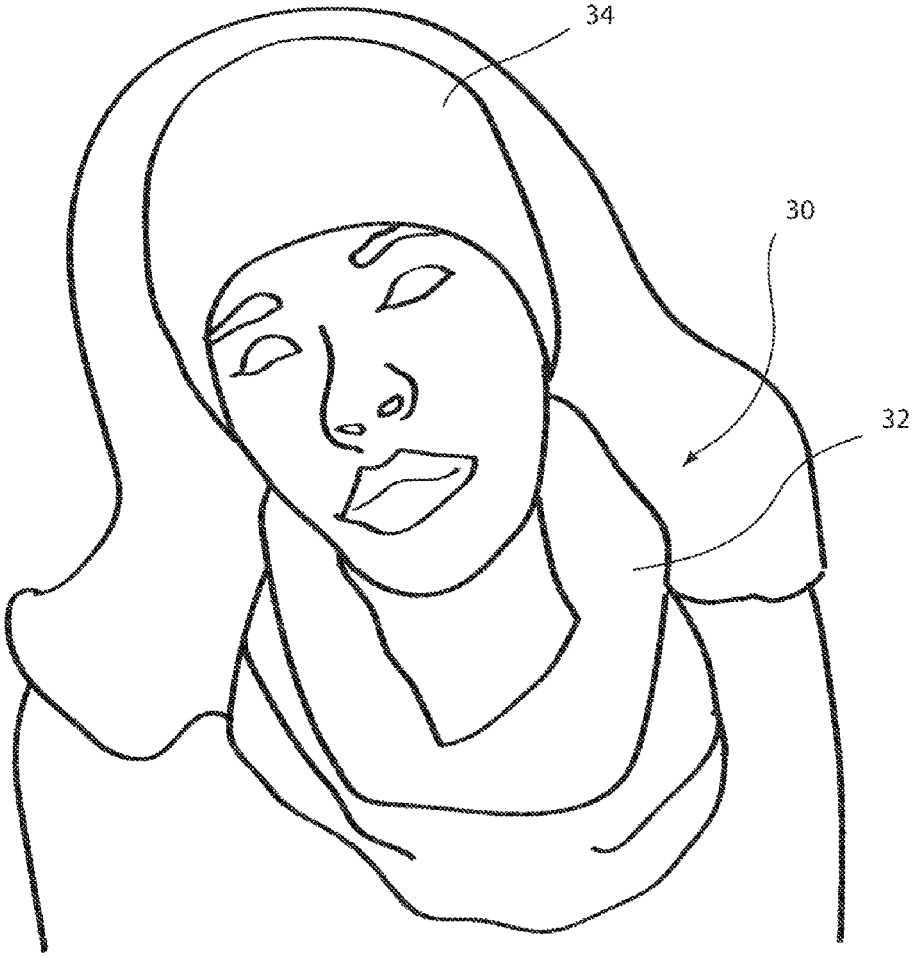
FIG. 3 is a front view of a one-piece clothing garment as it would appear on a wearer, according to various aspects of the present invention.

FIG. 3 is a front view of a one-piece clothing garment 30 as it would appear on a wearer, according to various aspects of the present invention. In this view, the scarf portion 32 can be seen around the wearer's neck, and the headband portion 34 can be seen as it would appear on the wearer's head. In this embodiment, the scarf portion 32 would keep the wearer's neck warm, and the headband portion 34 would keep the wearer's forehead warm. Additionally, in this embodiment, the clothing garment is made out of one-piece of fabric, so wearers neck would be kept warm where the scarf portion 32 transitions into the headband portion 34.

Advantageously, the present description provides one or more embodiments of various types of one-piece clothing garments. Each clothing garment depicted herein provides advantages that overcome shortcomings of other types of clothing garments that are used conventionally. Further, the various embodiments shown in the figures and described herein accommodate different sized heads or necks and may be used in various applications, including, but not limited to keeping a wearer's head and neck warm. It is noted that the various embodiments of clothing garments presented herein may be used in many other ways other than to keep a wearer's head warm. Thus, the various embodiments described in the present description include a number of novel and helpful components that provide enhanced pants garment to benefit a user.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A clothing garment comprising a headband portion and a scarf portion, wherein the headband portion is made out of a first loop that comprises a headband tube formed by sewing an elongated top side and an elongated bottom side together to form the headband tube having two ends that are connected together;

wherein the scarf portion is made out of a second loop that comprises a scarf tube formed by sewing an elongated top side and an elongated bottom side to form the scarf tube having two ends that are connected together; and wherein the headband portion first loop is connected with the scarf portion second loop at a connection point.

2. The clothing garment of claim 1, wherein the headband first loop portion has a width; and the connection point runs an entirety of the width of the headband first loop portion.

3. The clothing garment of claim 1, wherein the scarf second loop portion has a width; and the connection point runs an entirety of the width of the scarf second loop portion.

4. The clothing garment of claim 1, wherein the two ends of the headband tube are sewn together to form the headband loop portion;

wherein the two ends of the scarf tube are sewn together to form the scarf loop portion; and wherein the headband loop portion and the scarf loop portion are sewn together to form the connection point between the headband loop portion and the scarf loop portion.

5. The clothing garment of claim 1, further comprising pulling the headband tube and scarf tube portions inside out to hide sewing seams formed by sewing together the respective elongated top and bottom sides of the headband and scarf tubes.

6. The clothing garment of claim 4, wherein the sewn portions are formed by single or double stitch sewing.

7. The clothing garment of claim 1, further comprising a first slit on a first end of the connection point and a second slit on a second end of the connection point to form a narrowed connection point that lies between the first and second slits.

8. The clothing garment of claim 1, wherein the garment is constructed from a single piece of fabric.

9. The clothing garment of claim 1, wherein an indent is formed at the connection point when the headband loop portion is pulled up and away from the scarf loop portion.

10. The clothing garment of claim 1, wherein the headband loop portion and the scarf each have a width and the widths of the headband loop portion and the scarf portion are the same size.

11. The clothing garment of claim 1, wherein the headband loop portion and the scarf each have a width and the widths of the headband loop portion and the scarf portion are different sizes.

12. The clothing garment of claim 1, wherein the clothing garment is made out of a stretchable fabric.

13. The clothing garment of claim 1, wherein the clothing garment is made out of a fabric selected from the group consisting of polyesters, cotton, wool, denim, leather, down, fur, nylon, and spandex.

14. A method of making a clothing garment comprising:

cutting out a clothing material comprising a scarf portion and a headband portion from a piece of fabric, sewing together an elongated top side and an elongated bottom side of the headband portion to form a headband tube having two ends;

sewing together an elongated top side and an elongated bottom side of the scarf portion to form a scarf tube having two ends;

forming a headband loop by sewing together the two ends of the headband tube;

forming a scarf loop by sewing together the two ends of the scarf tube; and connecting the headband and scarf loops at a connection point.

15. The method of claim 14, wherein the clothing garment is constructed from a single piece of fabric.

16. The method of claim 14, wherein the scarf portion and a headband portion cut from a clothing material each have a width and the widths of the scarf portion and the headband portion are the same size.

17. The method of claim 14, wherein the scarf portion and a headband portion cut from a clothing material each have a width and the widths of the scarf portion and the headband portion are different sizes.

18. The method of claim 14, wherein the sewing together of the two ends of the headband loop and the sewing together of the two ends of the scarf loop are done at the connection point.

19. The method of claim 18, further comprising cutting a first slit on a first end of the connection point and cutting a second slit on a second end of the connection point to form a narrowed connection point that lies between the first slit and the second slit; and wherein the cutting of the first slit and the second slit is done prior to forming the headband loop and the scarf loop.

20. The method of claim 14, further comprising pulling the headband and scarf tubes inside out to hide sewing seams that are formed by sewing together the respective elongated top and bottom sides of the headband loop and scarf loop portions.

* * * * *